US010199001B2

(12) United States Patent
Enami

(10) Patent No.: US 10,199,001 B2
(45) Date of Patent: Feb. 5, 2019

(54) ELECTROOPTICAL DEVICE, CONTROL METHOD OF ELECTROOPTICAL DEVICE, AND ELECTRONIC DEVICE

(71) Applicant: SEIKO EPSON CORPORATION, Tokyo (JP)

(72) Inventor: Shinta Enami, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/436,201

(22) Filed: Feb. 17, 2017

(65) Prior Publication Data

US 2017/0270875 A1 Sep. 21, 2017

(30) Foreign Application Priority Data

Mar. 17, 2016 (JP) ..... 2016-054111

(51) Int. Cl.
*G09G 3/36* (2006.01)

(52) U.S. Cl.
CPC ..... *G09G 3/3607* (2013.01); *G09G 3/3677* (2013.01); *G09G 3/3688* (2013.01); *G09G 3/3696* (2013.01); *G09G 2300/0478* (2013.01); *G09G 2310/0251* (2013.01); *G09G 2310/0278* (2013.01); *G09G 2310/0297* (2013.01); *G09G 2330/021* (2013.01)

(58) Field of Classification Search
None
See application file for complete search history.

(56) References Cited

U.S. PATENT DOCUMENTS

2003/0141504 A1* 7/2003 Kuwabara ..... H01L 27/1214 257/66
2008/0100605 A1* 5/2008 Shirai ..... G09G 3/3688 345/206
2012/0056917 A1 3/2012 Ito

FOREIGN PATENT DOCUMENTS

JP 2006-308712 A 11/2006
JP 2010-102217 A 5/2010
JP 2012-053407 A 3/2012

* cited by examiner

*Primary Examiner* — Gustavo Polo
(74) *Attorney, Agent, or Firm* — Oliff PLC

(57) ABSTRACT

An increase in power consumption is suppressed even in a case of applying a precharge signal to all data lines at the same time. A voltage output selection circuit that is connected to a data line drive circuit in an input stage and is connected to data lines in an output stage is provided. The voltage output selection circuit selects connection and non-connection between the data lines and the data line drive circuit when a precharge voltage is applied. A control circuit controls the voltage output selection circuit such that connection between the data lines and the data line drive circuit is selected in a first region in which an image is displayed, and non-connection between the data lines and the data line drive circuit is selected in a second region covered with a light shielding layer.

9 Claims, 6 Drawing Sheets

ELECTROOPTICAL DEVICE, CONTROL METHOD OF ELECTROOPTICAL DEVICE, AND ELECTRONIC DEVICE

BACKGROUND

1. Technical Field

The present invention relates to technical fields of an electrooptical device such as a liquid crystal device, a control method of the electrooptical device, and an electronic device provided with the electrooptical device, such as a liquid crystal projector.

2. Related Art

Electrooptical devices that use liquid crystal elements to display images have widely been developed. According to such electrooptical devices, the transmittance of liquid crystals provided in the respective pixels is controlled to be a transmittance in accordance with designated tones of image signals by supplying the image signals for designating the display tones of the respective pixels to the respective pixels via data lines, and in doing so, the respective pixels are made to display the tones designated by the image signals.

Incidentally, in a case where image signals are not sufficiently supplied, for example, in a case where sufficient time for supplying image signals to the respective pixels cannot be secured, the respective pixels cannot accurately display the tones designated by the image signals, and display quality may deteriorate. In order to respond to the problem of the deterioration of display quality due to such insufficient writing of the image signals in the pixels, the following measure is employed in the related art. For example, a technology of facilitating the writing of image signals in the respective pixels by supplying a precharge signal with a potential that is close to a potential of the image signals to the respective pixels and the data lines prior to the supply of the image signals has been proposed in JP-A-2010-102217.

The precharge signal is an auxiliary signal for writing a voltage in all the VID signal lines or the data lines in advance prior to the writing of the image signals. Writing support and various correction failures are improved by writing a specific voltage (precharge signal) in the period.

A portion except for a synchronization signal in a blanking period in a horizontal fly-back period is referred to as a porch, and portions temporally before and after the synchronization signal are referred to as a front porch and a back porch, respectively. The precharge signal is basically applied by using the portion of the back porch in the horizontal fly-back period.

However, since the precharge signal is simultaneously applied to all the data lines by using the back porch portion, power consumption increases. In a case where the number of the data lines increases for an increase in resolution, in particular, the power consumption significantly increases, and a period that can be used for applying the precharge signal becomes shorter. Although it is considered to increase instantaneous charge transfer in order to shorten the application time of the precharge signal, the power consumption further increases due to an increase in the amount of a current.

SUMMARY

An advantage of some aspects of the invention is to provide an electrooptical device that can suppress an increase in power consumption even in a case of applying a precharge signal to all data lines at the same time, a control method of the electrooptical device, and an electronic device provided with the electrooptical device.

According to an aspect of the invention, there is provided an electrooptical device including: a plurality of scanning lines; a plurality of data lines; pixels that are provided so as to correspond to intersections between the plurality of scanning lines and the plurality of data lines; a scanning line drive unit that supplies a scanning signal to the scanning lines; a data line drive unit that supplies a first voltage with a magnitude in accordance with a tone to be displayed to the pixels via the data lines and supplies a second voltage to the data lines before the supply of the first voltage; a voltage output selection unit that is connected to the data line drive unit in an input stage, is connected to the data lines in an output stage, and selects connection and non-connection between the data lines and the data line drive unit when the second voltage is supplied; and a control unit that controls the voltage output selection unit such that connection between the data lines and the data line drive unit is selected in a first region and non-connection between the data lines and the data line drive unit is selected in a second region.

According to the aspect, the data line drive unit supplies the first voltage with the magnitude in accordance with the tone to be displayed to the pixels via the data lines, and the second voltage is supplied to the data lines before the supply of the first voltage. However, the voltage output selection unit selects non-connection between the data lines and the data line drive unit in the second region and selects connection between the data lines and the data line drive unit in the first region when the second voltage is supplied under the control by the control unit. Therefore, the second voltage is not supplied to the data lines in the second region while the second voltage is supplied to the data lines in the first region. As a result, no power consumption is required for writing the second voltage in the data lines in the second region, and power consumption is reduced as a whole.

In this case, the second region may be arranged in each of stages before and after the first region in an arrangement direction of the scanning lines along the data lines. According to the aspect, since the second region where the second voltage is not supplied is arranged in each of the stages before and after the first region, there is no influence on display quality in the first region.

In this case, the second region may be a region covered with a light shielding layer formed above a layer with the pixels provided thereon when viewed from a side of an image display surface. According to the aspect, since the second region where the second voltage is not supplied is a region covered with the light shielding layer, there is no influence on display quality in a case of being viewed from the side of the image display surface.

In this case, the control unit may determine the first region and the second region based on control information input from the outside. According to the aspect, the control information is input from the outside to the control unit, and the control unit determines the first region and the second region based on the control information. Therefore, it is possible to easily cope with a change in the range of the second region, if any.

According to another aspect of the invention, there is provided a control method of an electrooptical device that includes a plurality of scanning lines, a plurality of data lines, and pixels that are provided so as to correspond to the respective intersections between the plurality of scanning lines and the plurality of data lines, the method including: supplying a scanning signal to the scanning lines; supplying a first voltage with a magnitude in accordance with a tone to be displayed to the pixels via the data lines; supplying a second voltage to the data lines before the supply of the first voltage; and connecting the data lines and an output unit of the second voltage in a first region and not connecting the data lines and the output unit of the second voltage in a second region when the second voltage is supplied.

In this case, the second region may be arranged in each of stages before and after the first region in an arrangement direction of the scanning lines along the data lines.

In this case, the second region may be a region covered with a light shielding layer formed above a layer with the pixels provided thereon when viewed from a side of an image display surface.

In this case, the first region and the second region may be determined based on control information input from the outside.

According to these aspects, the first voltage with the magnitude in accordance with the tone to be displayed is supplied to the pixels via the data lines, and the second voltage is supplied to the data lines before the supply of the first voltage. However, the data lines and the output unit of the second voltage are not connected in the second region while the data lines and the output unit of the second voltage are connected in the first region when the second voltage is supplied. Therefore, the second voltage is not supplied to the data lines in the second region, and the second voltage is supplied to the data lines in the first region. As a result, no power consumption is required for writing the second voltage in the data lines in the second region, and power consumption is reduced as a whole.

According to still another aspect of the invention, there is provided an electronic device including: the aforementioned electrooptical device. According to such an electronic device, since the second voltage is not written in the data lines in the second region, power consumption is reduced in a display device such as a liquid crystal display.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
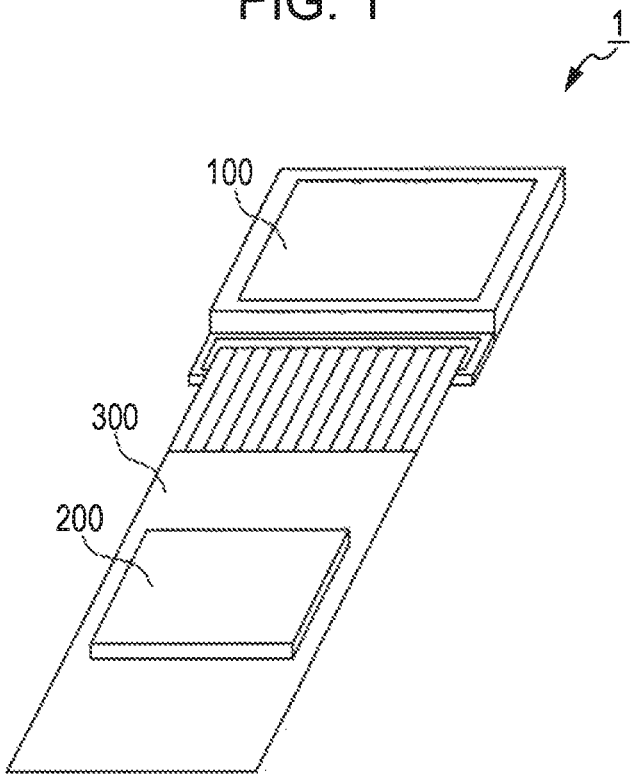
FIG. 1 is an explanatory diagram of an electrooptical device according to a first embodiment of the invention.

Description will be given of an embodiment of the invention with reference to FIGS. 1 to 5. FIG. 1 is a diagram illustrating a configuration of a signal transmission system for an electrooptical device 1. As illustrated in FIG. 1, the electrooptical device 1 includes an electrooptical panel 100, a drive integrated circuit 200, and a flexible circuit board 300, and the electrooptical panel 100 is connected to the flexible circuit board 300 on which the drive integrated circuit 200 is mounted. The electrooptical panel 100 is connected to a substrate of a host CPU device, which is not illustrated in the drawing, via the flexible circuit board 300 and the drive integrated circuit 200. The drive integrated circuit 200 is a device that receives image signals and various control signals for drive and control from the host CPU device via the flexible circuit board 300 and drives the electrooptical panel 100 via the flexible circuit board 300.

Figure 2:
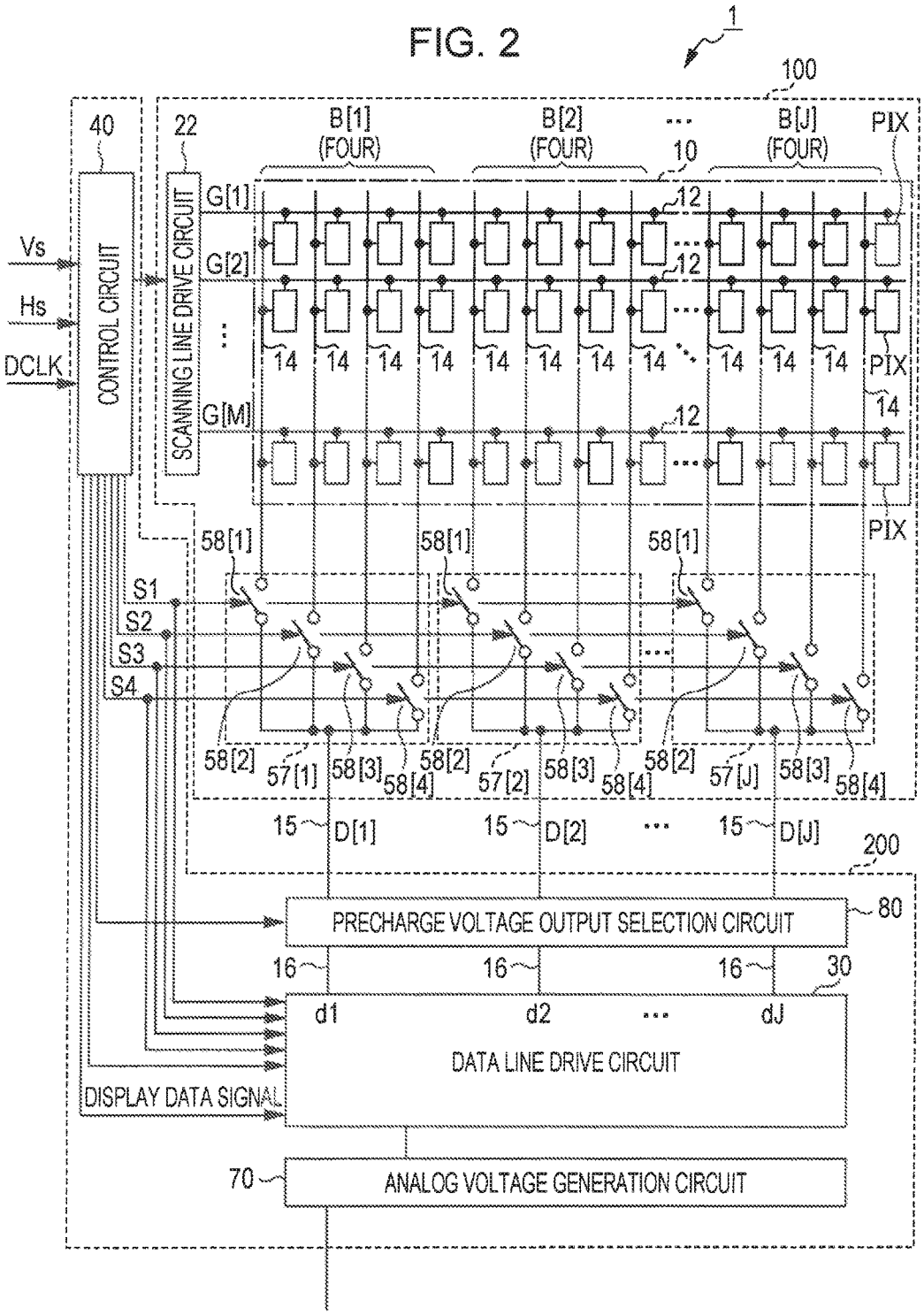
FIG. 2 is a block diagram illustrating a configuration of the electrooptical device according to the embodiment.

FIG. 2 is a block diagram illustrating configurations of the electrooptical panel 100 and the drive integrated circuit 200. As illustrated in FIG. 2, the electrooptical panel 100 includes a pixel unit 10, a scanning line drive circuit 22 as the scanning line drive unit, and J demultiplexers 57[1] to 57[J] (J is a natural number). The drive integrated circuit 200 includes a data line drive circuit 30 as the data line drive unit, a control circuit 40 as the control unit, an analog voltage generation circuit 70, and a precharge voltage output selection circuit 80 as the voltage output selection unit.

In the pixel unit 10, M scanning lines 12 and N data lines 14 that intersect each other are formed (M and N are natural numbers). A plurality of pixel circuits (pixels) PIX are provided so as to correspond to intersections between the respective scanning lines 12 and the respective data lines 14 and are aligned in a matrix shape of M rows in the longitudinal direction and N columns in the transverse direction.

Figure 4:
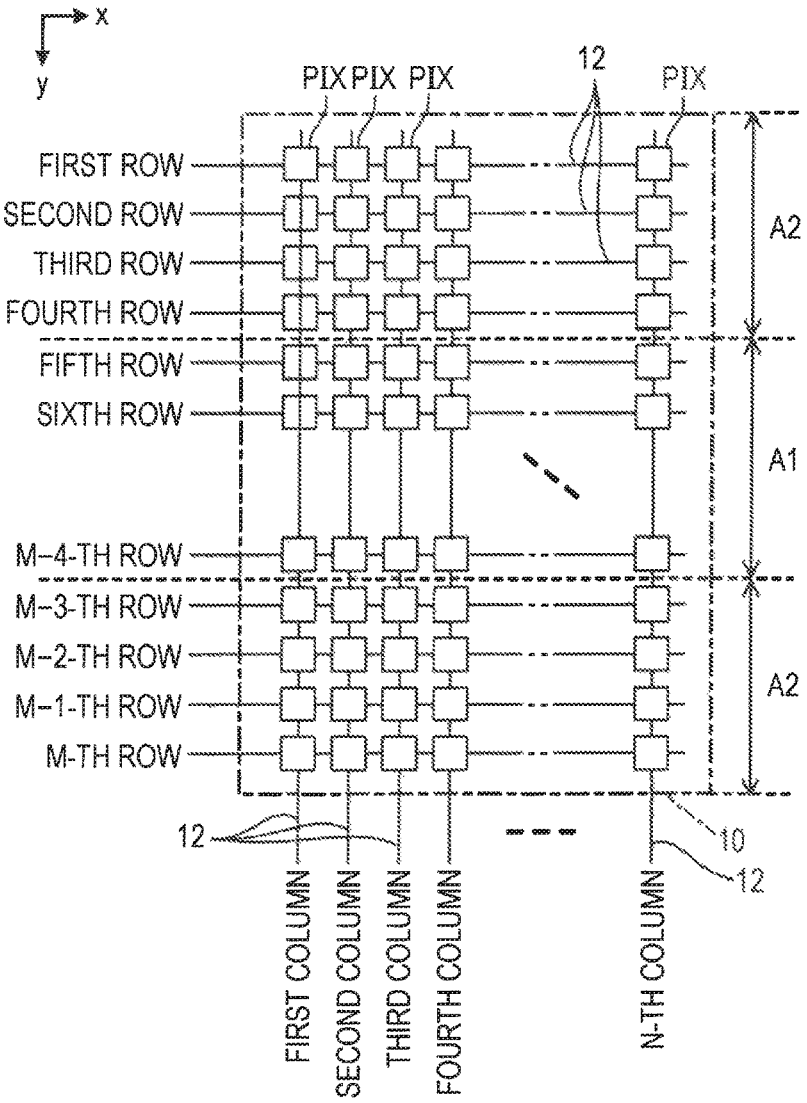
FIG. 4 is an explanatory diagram of a first region and a second region.

FIG. 4 is a diagram schematically illustrating regions in the pixel unit 10. The plurality of scanning lines 12 extend in the x direction (horizontal direction) and are arranged (aligned) in the y direction (vertical direction), the plurality of data lines 14 extend in the y direction and arranged (aligned) in the x direction, and the plurality of pixels are formed so as to correspond to intersections between the scanning lines 12 and the data lines 14. As illustrated in FIG. 4, the pixel unit 10 is divided into a display region A1 as the first region and a peripheral region A2 as the second region. As illustrated in FIG. 4, the peripheral region A2 (second region) is arranged in each of stages before and after the display region A1 (first region) in the arrangement direction (alignment direction) of the scanning lines 12 along the data lines 14. The display region A1 is a region that is actually used for image display (effective display region), and the peripheral region A2 sectioned in the periphery of the display region A1 is a region that does not contribute to image display (that is, a dummy region in which an observer cannot view a displayed image). A light shielding layer is formed above a layer with the pixel unit 10 provided thereon when viewed from the side of a display screen of the electrooptical device 1 illustrated in FIG. 1. The peripheral region A2 is a region corresponding to a region where the light shielding layer is formed.

In this example, M is equal to or greater than 11, and M−8 scanning lines 12 on the fifth to M−4-th rows from among the M scanning lines 32 in the pixel unit 10 correspond to the display region A1, and four scanning lines 12 on the first to fourth rows and four scanning lines 12 from the M−3-th to M-th rows correspond to the peripheral region A2. The respective pixels PIX on M−8 rows in the vertical direction and N columns in the horizontal direction corresponding to the scanning lines 12 in the display region A1 correspond to effective pixels that are arranged in the display region A1 in the pixel unit 10 and effectively contribute to image display. Also, the respective pixels PIX (first to fourth rows and M−3-th to M-th rows) corresponding to the scanning lines 12 in the peripheral region A2 in the pixel unit 10 correspond to dummy pixels that actually does not contribute to image display. If an attention is paid to an arbitrary one column in the pixel unit 10, four dummy pixels PIX are aligned in each of both sides of M−8 effective pixels PIX in the display region A1. Here, description of the dummy pixels PIX located on positive and negative sides of the display region A1 in the x direction will be omitted for convenience.

Figure 3:
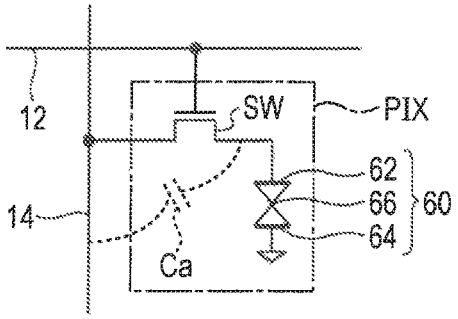
FIG. 3 is a circuit diagram illustrating a configuration of a pixel.

FIG. 3 is a circuit diagram of each pixel circuit PIX. As illustrated in FIG. 3, each pixel circuit PIX includes a liquid crystal element 60 and a switching element SW such as a TFT. The liquid crystal element 60 is an electrooptical element configured of a pixel electrode 62 and a common electrode 64, which face each other, and a liquid crystal 66 between both the electrodes. Transmittance (display tone) of the liquid crystal 66 varies in accordance with a voltage applied between the pixel electrode 62 and the common electrode 64. Another configuration is also employed in which an auxiliary capacitance is connected in parallel with the liquid crystal element 60. The switching element SW is formed of an N-channel transistor with a gate connected to the scanning line 12, for example, is provided between the liquid crystal element 60 and the data line 14, and controls electrical connection (conduction/non-conduction) therebetween. The switching elements SW in the respective pixel circuits PIX on the m-th row are shifted to an ON state at the same time by setting the scanning signal Y[m] to a selection potential (m=1 to M).

When scanning lines 12 corresponding to pixel circuits PIX are selected and switching elements SW of the pixel circuits PIX are controlled in the ON state, a voltage in accordance with an image signal D[j] (j=1 to J) supplied from the data lines 14 to the pixel circuits PIX is applied to liquid crystal elements 60 of the pixel circuits PIX. As a result, a transmittance in accordance with the image signal D is set for the liquid crystals 66 of the pixel circuits PIX. If a light source that is not illustrated in the drawing is brought in to the ON (turned on) state) and the light source emits light, the light penetrates the liquid crystals 66 of the liquid crystal elements 60 provided in the pixel circuits PIX and advances toward the side of the observer. That is, the pixels corresponding to the pixel circuits PIX display a tone in accordance with the image signal D[j] by the voltage in accordance with the image signal D[j] being applied to the liquid crystal elements 60 and the light source being brought into the ON state.

If the switching elements SW is brought into the OFF state after the voltage in accordance with the mage signal D[j] is applied to the liquid crystal elements 60 of the pixel circuits PIX, the applied voltage in accordance with the image signal D[j] is ideally held. Therefore, the respective pixels ideally display the tone in accordance with the image signal D[j] in a period after the switching elements SW is brought into the ON state until the switching elements SW is brought into the ON state next time.

As illustrated in FIG. 3, a capacitance Ca is parasitic between the data line 14 and the pixel electrode 62 (or between the data line 14 and a wiring that electrically connects the pixel electrode 62 and the switching element SW). Therefore, variations in the potential of the data line 14 propagates to the pixel electrode 62 via the capacitance Ca and the application voltage of the liquid crystal element 60 varies while the switching element SW is in the OFF state, in some cases.

In addition, a common voltage LCCOM as a constant voltage is supplied to the common electrode 64 via a common line that is not illustrated in the drawing. As the common voltage LCCOM, a voltage of about −0.5 V is used on the assumption that the center voltage of the image signal D[j] is 0 V. This is based on properties of the switching element SW and the like.

In order to prevent so-called ghosting, polarity reversion drive of reversing polarity of the voltage to be applied to the liquid crystal element 60 in a predetermined period is employed in this embodiment. In this example, the level of the image signal D[j] supplied to the pixel circuits PIX via the data lines 14 is reversed every unit period with respect to the center voltage of the image signal D[j]. The unit period is a period corresponding to one unit of the operation of driving the pixel circuit PIX. In this example, the unit period is a vertical scanning period V. However, the unit period can be arbitrarily set and may be a multiple natural number of the vertical scanning period V, for example. In this embodiment, a case where the image signal D[j] has a higher voltage than the center voltage of the image signal D[j] will be regarded as positive polarity, and a case where the image signal D[j] has a lower voltage than the center voltage of the image signal D[j] will be regarded as negative polarity.

Description will be returned to FIG. 2. The external host CPU device that is not illustrated in the drawing inputs external signals such as a vertical synchronization signal Vs for defining the vertical scanning period V, a horizontal synchronization signal Hs for defining a horizontal scanning period H, and a dot clock signal DCLK to the control circuit 40. The control circuit 40 controls the scanning line drive circuit 22, the data line drive circuit 30, and the precharge voltage output selection circuit 80 in a synchronized manner based on these signals. Under the control in the synchronized manner, the scanning line drive circuit 22 and the data line drive circuit 30 cooperate and control display by the pixel unit 10.

Generally, display data configuring one display screen is processed in unit of frames, and a processing period is one frame period (1F). The frame period F corresponds to the vertical scanning period V in a case where one display screen is formed of vertical scanning performed once.

The scanning line drive circuit 22 outputs scanning signals G[1] to G[M] to each of M scanning lines 12. The scanning line drive circuit 22 sequentially brings the scanning signals G[1] to G[M] to the respective scanning lines 12 into an active level in every horizontal scanning period (1H) during the vertical scanning period V in accordance with an output of the horizontal synchronization signal Hs from the control circuit 40.

Here, the respective switching elements SW in N pixel circuits PIX on the m-th row are in the ON state during a period in which the scanning signal G[m] corresponding to the m-th row is in the active level and the scanning lines corresponding to the row are selected. As a result, the N data lines 14 are electrically connected to the respective pixel electrodes 62 in the N pixel circuits PIX on the m-th row via these respective switching elements SW.

The N data lines 14 in the pixel unit 10 are divided into J wiring blocks B[1] to B[J] in units of four mutually adjacent data lines 14 (K=4) in this example (J=N/4; N is a multiple number of 4 in this example). In other words, the data lines 14 are grouped into wiring groups B. The demultiplexers 57[1] to 57[J] respectively correspond to the J wiring blocks B[1] to B[J].

Each demultiplexer 57[*j*] (j=1 to J) as the data line selection unit is configured of four switches 58[1] to 58[4]. In each demultiplexer 57[*j*], one contact point of each of the four switches 58[1] to 58[4] is commonly connected. In addition, the commonly connected point of the one contact point of each of the four switches 58[1] to 58[4] in the demultiplexer 57[*j*] is connected to each of J VID signal lines 15. The J VID signal lines 15 are connected to the precharge voltage output selection circuit 80 of the drive integrated circuit 200 via the flexible circuit board 300. The precharge voltage output selection circuit 80 is connected to the data line drive circuit 30 with J output lines 16 in the drive integrated circuit 200.

In each demultiplexer 57[*j*], the other contact point of each of the four switches 58 [1] to 58 [4] is connected to each of the four data lines 14 configuring the wiring block B[j] corresponding to the demultiplexer 57[*j*].

The ON/OFF states of the four switches 58[1] to 58[4] in each demultiplexer 57[*j*] are switched by four selection signals S1 to S4. The four selection signals S1 to S4 are supplied from the control circuit 40 of the drive integrated circuit 200 via the flexible circuit board 300. Here, only J switches 58[1] that respectively belong to the demultiplexers 57[*j*] are turned on in a case where one selection signal S1 is in an active level while the other three selection signals S2 to S4 are in a non-active level, for example. Therefore, the respective demultiplexers 57[*j*] output the image signals D[1] to D[J] on the J VID signal lines 15 to the first data lines 14 in the respective Tiring blocks B[1] to B[J]. Thereafter, the image signals D[1] to D[J] on the J VID signal lines 15 are output to the second, third, and fourth data lines 14 in the respective wiring blocks B[1] to B[J] in the same manner.

The control circuit 40 includes a frame memory, at least has a memory space of M×N bits corresponding to resolution of the pixel unit 10, and stores and holds, in units of frames, display data input from the external host CPU device. Here, the display data that defines the tone of the pixel unit 10 is 64-tone data configured of 6 bits in one example. The display data read from the frame memory is transferred as the display data signal in series to the data line drive circuit 30 via a 6-bit bus.

The control circuit 40 may be configured to include a line memory for at least one line. In such a case, the display data for one line is accumulated in the line memory, and the display data is transferred to the respective pixels.

In addition, the control circuit 40 controls the precharge voltage output selection circuit 80, which will be described later, in accordance with display data display timing and precharge signal application timing. Detailed description will be given later.

The data line drive circuit 30 as the data line drive unit cooperates with the scanning line drive circuit 22 and outputs data to be supplied to each pixel row as a data writing target to the data lines 14. The data line drive circuit 30 generates latch signals based on the selection signals S1 to S4 output from the control circuit 40 and sequentially latches the precharge signal and N 6-bit display data signals supplied as serial data. The display data signals are grouped into chronological data for every four pixels in this example. In addition, the data line drive circuit 30 is provided with a Digital to Analog (D/A) conversion circuit as the D/A conversion unit. The D/A conversion circuit performs D/A conversion based on grouped digital data and an analog voltage generated by the analog voltage generation circuit 70 and generates a voltage as analog data. In doing so, the display data signals aligned in the chronological manner in units of four pixels are also converted into a predetermined data voltage (first voltage). Also, the precharge signal is converted into a predetermined precharge voltage (second voltage), and a set of the precharge voltage and the data voltage corresponding to four pixels is supplied to the respective VID signal lines 15 in this order. As described above, the data line drive circuit 30 also functions as an output unit of the precharge voltage as the second voltage.

Conduction (ON/OFF) of the respective switches 58[1] to 58[4] in the respective demultiplexers 57[*j*] are controlled by the selection signals S1 to S4 output from the control circuit 40, and the respective switches 58[1] to 58[4] are turned on at predetermined timing. In a precharge signal application period, the conduction is controlled by the selection signals S1 to S4 output from the control circuit 40, and the respective switches 58[1] to 58[4] in the demultiplexers 57[*j*] are turned on at the same time.

In this way, the precharge voltage and the data voltage for four pixels supplied to the respective VID signal lines 15 are output to the data lines 14 in a chronological manner by the switches 58[1] to 58[4] in one horizontal scanning period (1H).

Since polarity reversion drive is employed, and also, two-stage precharge is employed, four precharge voltages are used in the embodiment. Precharge means writing of a predetermined voltage in all the VID signal lines 15 and the data lines 14 in advance before writing the image signals (data voltage) in the data lines 14. In addition, the two-stage precharge means precharge that includes precharge in the first stage and precharge in the second stage and is performed in a stepwise manner. The first precharge is precharge of setting a level of the precharge voltage to a voltage level for black display (low-potential precharge voltage), for example, in order to prevent vertical crosstalk. In the second precharge, a voltage level for an intermediate tone (high-potential precharge voltage), for example, is set in order to support writing by the data line drive circuit 30.

The control circuit 40 determines timing at which the scanning signals on the respective rows are brought into an active level in synchronization with the horizontal synchronization signal Hs. Furthermore, the control circuit 40 controls the precharge voltage output selection circuit 80 such that the output of the data line drive circuit 30 and the data lines 14 are not connected (not conducted) at timing at which the scanning signals on the first to fourth rows are brought into the active level. Also, the control circuit 40 controls the precharge voltage output selection circuit 80 such that the output of the data line drive circuit 30 and the data lines 14 are connected (conducted) at timing at which the scanning signals on the fifth to M−4-th rows are brought into the active level. Furthermore, the control circuit 40 controls the precharge voltage output selection circuit 80 such that the output of the data line drive circuit 30 and the data lines 14 are not connected at timing at which the scanning signals on the M−3-th to M-th rows are brought into the active level. Detailed description will be given below.

Figure 5:
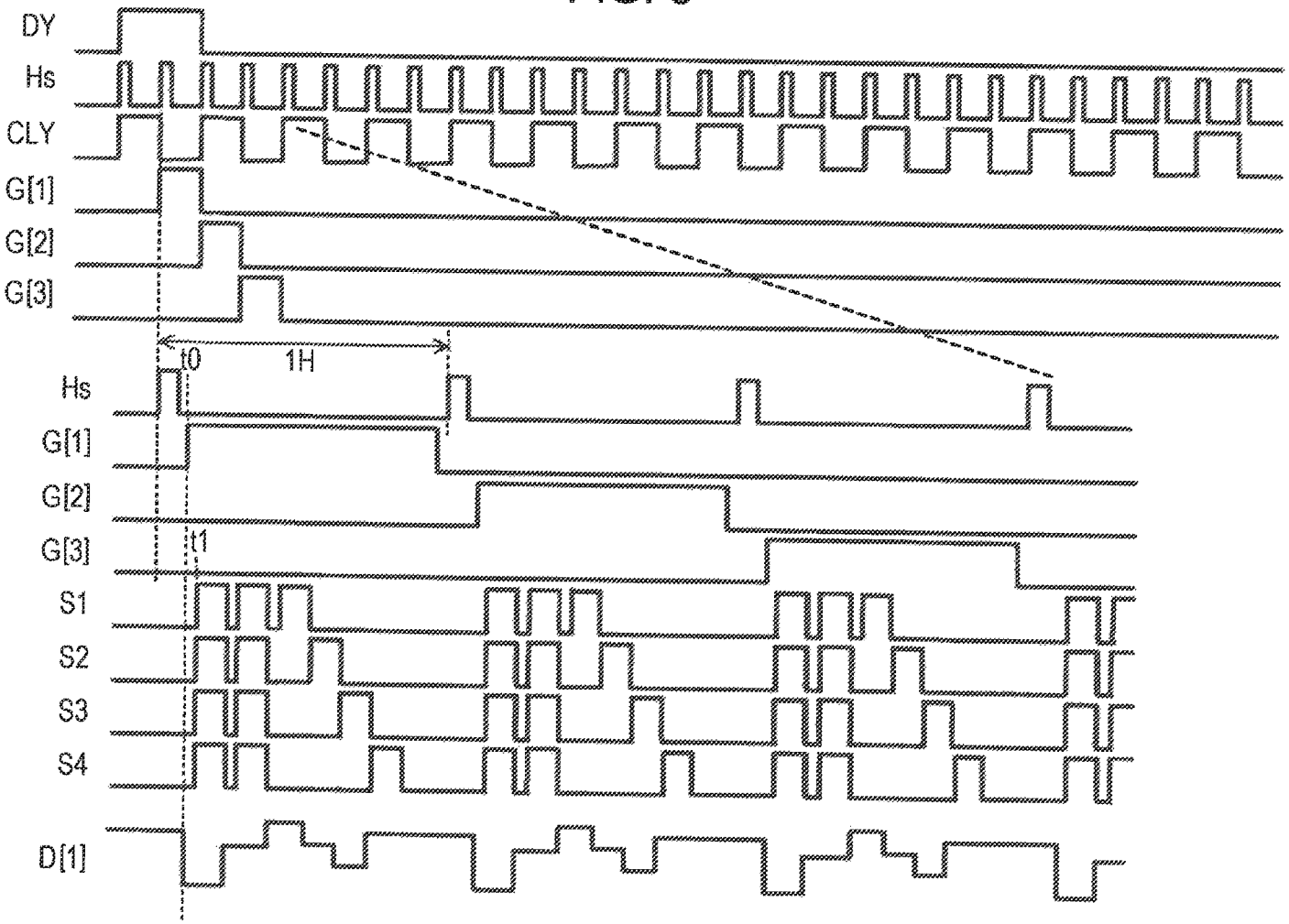
FIG. 5 is a timing chart of a drive integrated circuit.

FIG. 5 is a timing chart of the drive integrated circuit 200. If the horizontal synchronization signal Hs is input from the external host CPU device to the control circuit 40, the control circuit 40 drives the scanning line drive circuit 22 in synchronization with the horizontal synchronization signal Hs. The scanning line drive circuit 22 generates scanning signals G[1], G[2], . . . , G[M] by sequentially shifting a signal corresponding to a Y transfer start pulse DY of a one frame (1F) cycle in accordance with a Y clock signal CLY. The scanning signals G[1], G[2], . . . , G[M] are sequentially set in an active state in one horizontal scanning period (1H). The data line drive circuit 30 generates sampling pulses SP1, SP2, . . . , SPz (not illustrated) based on an X transfer start pulse DX (not illustrated) of a horizontal scanning cycle and an X clock signal CLX (not illustrated).

The data line drive circuit 30 outputs a precharge voltage based on the precharge signal. The data line drive circuit 30 generates the image signals D[1] to D[J] by sampling image signals VID1 to VIDJ (not illustrated) including the display data signals and the precharge signals by using sampling pulses SP1, SP2, . . . , SPz (not illustrated). The image signals D[1] to D[j] are set at the data voltage and the precharge voltage.

The control circuit 40 outputs the selection signals S1 to S4 to the data line drive circuit 30 and the four switches 58[1] to 58[4] in each demultiplexer 57[*j*] in synchronization with the horizontal synchronization signal Hs. The data line drive circuit 30 outputs the image signals D[1] to D[j] to the VID signal lines 15 from output terminals d1 to dJ via the output lines 16 and the precharge voltage output selection circuit 80. The four switches 58[1] to 58[4] in each demultiplexer 57[*j*] are turned on and off based on the selection signals S1 to S4.

The control circuit 40 outputs the precharge signals and the display data signals as serial data (image signals VID) to the data line drive circuit 30 at timing t0 at which the scanning signal G[1] is brought into the active state. In addition, the control circuit 40 outputs the selection signals S1 to S4 for turning on the switches 58[1] to 58[4] at the same time at timing t1.

However, the control circuit 40 controls the precharge voltage output selection circuit 80 such that the data line drive circuit 30 and the VID signal lines 15 are not connected, that is, such that the data line drive circuit 30 and the data lines 14 are not connected in a period in which the scanning signals G[1] to G[4] on the first to fourth rows are in the active state. As a result, the precharge voltage is not supplied to the data lines 14 that intersect the scanning lines 12 on the first to fourth rows in the peripheral region A2 (front stage) in the period. Also, the data voltage is not written in the pixels corresponding to the data lines 14 that intersect the scanning lines 12 on the first to fourth rows.

Next, the control circuit 40 output the precharge signals and the display data signals as serial data (image signals VID) to the data line drive circuit 30 at timing at which the scanning signal G[5] is brought in to the active state. In addition, the control circuit 40 outputs the selection signals S1 to S4 for turning on the switches 58[1] to 58[4] at the same time.

The control circuit 40 controls the precharge voltage output selection circuit 80 such that the data line drive circuit 30 and the VID signal lines 15 are connected, that is, such that the data line drive circuit 30 and the data lines 14 are connected in a period in which the scanning signals G[5] to G[M−4] on the fifth to M−4-th rows are in the active state. As a result, the precharge voltage is supplied to the data lines 14 that intersect the scanning lines 12 on the fifth to M−4-th rows in the display region A1 in the period. In addition, the data voltage is written in the pixels corresponding to the data lines 14 that intersect the scanning lines 12 on the fifth to M−4-th rows.

The control circuit 40 controls the precharge voltage output selection circuit 80 such that the data line drive circuit 30 and the VID signal lines 15 are not connected, that is, the data line drive circuit 30 and the data lines 14 are not connected in a period in which the scanning signals G[M−3] to G[M] on the M 3-th to M-th rows are in the active state. As a result, the precharge voltage is not supplied to the data lines 14 that intersect the scanning lines 12 on the M−3-th to M-th rows in the peripheral region A2 (later stage) in the period. In addition, the data voltage is not written in the pixels corresponding to the data lines 14 that intersect the scanning lines 12 on the M−3-th to M-th rows.

Similarly, the precharge voltage is not written in the data lines 14 in the peripheral region A2, the precharge voltage is written in the data lines 14, and the data voltage is written in the pixels in the display region A1 even in a period of negative polarity in the polarity reversion drive.

According to the embodiment, the control circuit 40 determines the display region A1 and the peripheral region A2 as selection regions for the scanning lines 12, and the precharge voltage is not written in the data lines 14 in a region determined to be the peripheral region A2 as described above. However, the precharge voltage is written in the data lines 14, and the data voltage is written in the pixels in a region determined to be the display region A1. Therefore, it is possible to suppress power consumption required for writing the precharge voltage in the peripheral region A2 and to thereby reduce power consumption as a whole.

Since the peripheral region A2 corresponds to the region where the light shielding layer is provided as described above, there is no influence on display quality even if the precharge voltage is not written therein.

Modification Examples

The invention is not limited to the aforementioned embodiments, and for example, various modifications descried below can be made. It is a matter of course that the respective embodiments and the respective modification examples may be appropriately combined.

(1) The aforementioned embodiment is an example in which polarity reversion drive is performed, two-stage precharge is performed, and the four precharge voltages are used as the precharge voltages. However, two precharge voltage may be used as the precharge voltages in an example in which the two-stage precharge is not performed even though the polarity reversion drive is performed or in an example in which the two-stage precharge is performed without performing the polarity reversion drive. In an example in which neither the polarity reversion drive nor the two-stage precharge are performed, one precharge voltage may be used as the precharge voltage.

(2) The aforementioned embodiment was described as the example in which the control circuit 40 determines the display region A1 and the peripheral region A2 as the selection regions of the scanning lines 12. However, the invention is not limited to such a configuration, and the display region A1 and the peripheral region A2 may be determined based on control information from the external host CPU device.

(3) Although a liquid crystal was exemplified as an example of the electrooptical material in the aforementioned embodiments, the invention is applied to electrooptical devices that use other electrooptical materials. The electrooptical material is a material with optical properties such as transmittance and luminance that vary in response to supply of an electric signal (a current signal or a voltage signal). For example, the invention can be applied to a display panel that uses light emitting elements such as an organic ElectroLuminescent (EL), inorganic EL, and light emitting polymer in the same manner as in the aforementioned embodiments. Also, the invention can be applied to an electrophoretic display pane using a microcapsule that includes colored liquid and white particles dispersed in the liquid as an electrooptical material in the same manner as in the aforementioned embodiments. Furthermore, the invention can be applied to a twist ball display panel using a twist ball with different colors applied to regions with different polarities as an electrooptical material in the same manner as in the aforementioned embodiment. The invention can also be applied to various electrooptical devices such as a toner display panel using a black toner as an electrooptical material and a plasma display panel using high-pressure gas such as helium or neon as an electrooptical material in the same manner as in the aforementioned embodiments.

Application Examples

Figure 6:
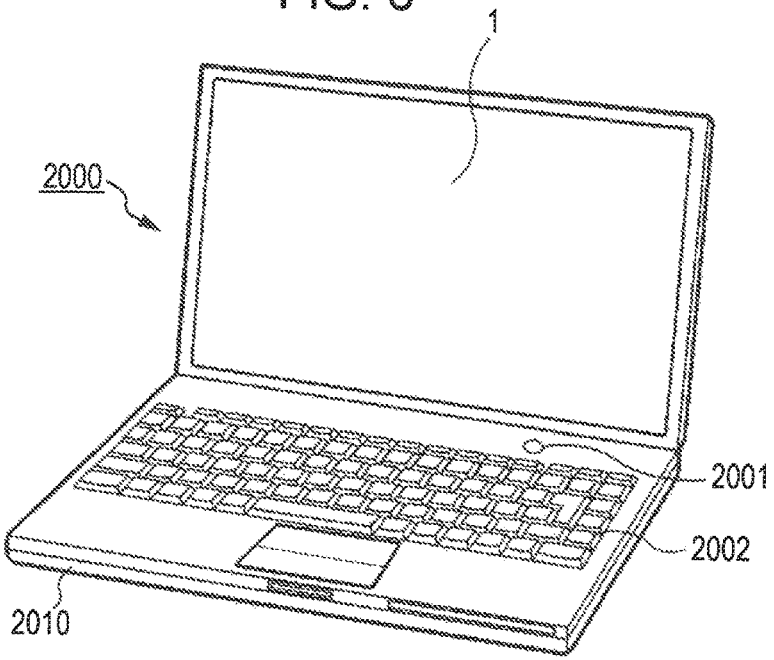
FIG. 6 is an explanatory diagram illustrating an example of an electronic device.
Figure 7:
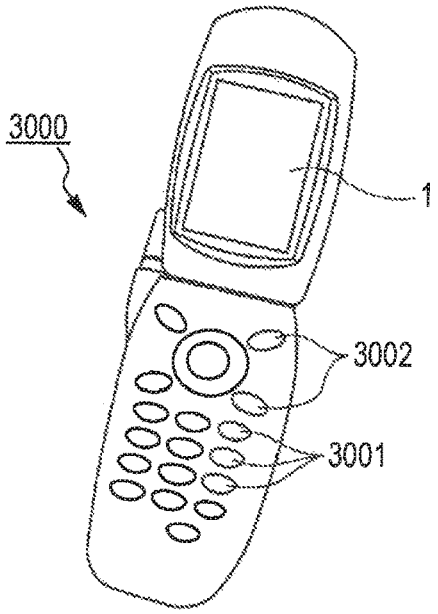
FIG. 7 is an explanatory diagram illustrating another example of the electronic device.
Figure 8:
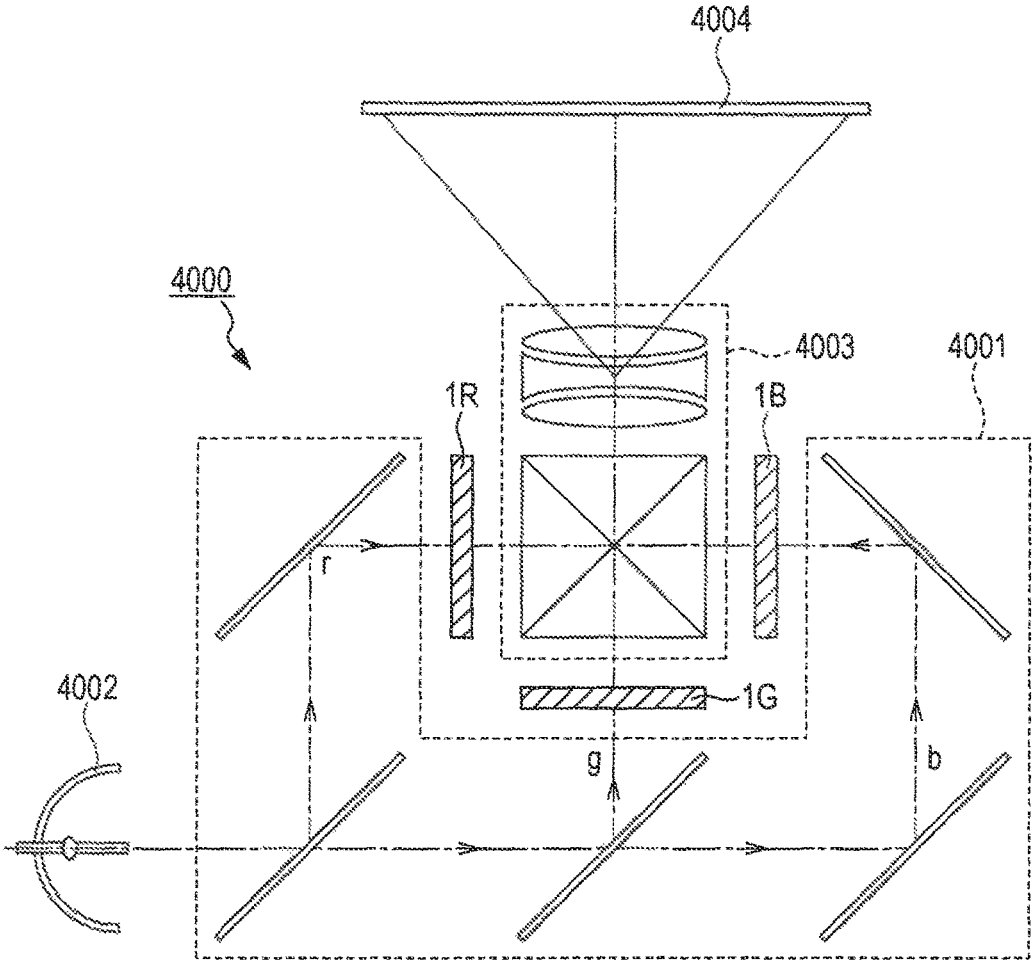
FIG. 8 is an explanatory diagram illustrating another example of the electronic device.

The invention can be utilized for various electronic devices. FIGS. 6 to 8 illustrate specific forms of the electronic devices as targets of applications of the invention.

FIG. 6 is a perspective view of a portable personal computer that employs the electrooptical device. A personal computer 2000 includes the electrooptical device 1 that displays various images and a main body 2010 with a power switch 2001 and a keyboard 2002 installed thereon.

FIG. 7 is a perspective view of a mobile phone. A mobile phone 3000 includes a plurality of operation buttons 3001, scroll buttons 3002, and the electrooptical device 1 that display various images. By operating the scroll buttons 3002, a screen displayed on the electrooptical device 1 is scrolled. The invention can also be applied to such a mobile phone.

FIG. 8 is a diagram schematically illustrating a configuration of a projection-type display apparatus (three-plate projector) 4000 that employs the electrooptical device. The projection-type display apparatus 4000 includes three electrooptical devices 1 (1R, 1G, and 1B) corresponding to different display colors R, G, and B, respectively. An illumination optical system 4001 supplies a red component r in light emitted from an illumination device (light source) 4002 to the electrooptical device 1R, supplies a green component g to the electrooptical device 1G, and supplies a blue component b to the electrooptical device 1B. The respective electrooptical devices 1 function as light modulators (light valves) that modulates the single color light supplied from the illumination optical system 4001 in accordance with a display image. A projection optical system 4003 synthesizes light emitted from the respective electrooptical devices 1 and projects the light to a projection surface 4004. The invention can also be applied to such a liquid crystal projector.

As electronic devices to which the invention is applied, a Personal Digital Assistant (PDA) is exemplified as well as the devices illustrated in FIGS. 1, 6, and 7. In addition, a digital still camera, a television, a video camera, a car navigation device, a display for a vehicle (instrument panel), an electronic databook, electronic paper, a calculator, a word processor, a work station, a video phone, and a POS terminal are exemplified. Furthermore, a printer, a scanner, a copy machine, a video player, and a device provided with a touch panel are exemplified.

This application claims priority from Japanese Patent Application No. 2016-054111 filed in the Japanese Patent Office on. Mar. 17, 2016, the entire disclosure of which is hereby incorporated by reference in its entirely.

What is claimed is:

1. An electrooptical device comprising:

a plurality of scanning lines;

a plurality of data lines;

pixels that are provided so as to correspond to intersections between the plurality of scanning lines and the plurality of data lines;

a scanning line drive unit that supplies a scanning signal to the scanning lines;

a data line drive unit that supplies a first voltage with a magnitude in accordance with a tone to be displayed to the pixels via the data lines and supplies a second voltage to the data lines before the supply of the first voltage;

a voltage output selection unit that is connected to the data line drive unit in an input stage, is connected to the data lines in an output stage, and selects connection and non-connection between the data lines and the data line drive unit when the second voltage is supplied; and a control unit that controls the voltage output selection unit such that connection between the data lines and the data line drive unit is selected when the scanning signal is supplied to the scanning lines in a first region and non-connection between the data lines and the data line drive unit is selected when the scanning signal is supplied to the scanning lines in a second region, wherein the first voltage is an image signal, the second voltage is a pre-charge signal different from the image signal, and the second voltage is supplied to only a fixed subset of the pixels, the fixed subset of the pixels being located in the first region.

2. The electrooptical device according to claim 1, wherein the second region is arranged in each of stages before and after the first region in an arrangement direction of the scanning lines along the data lines.

3. The electrooptical device according to claim 1, wherein the second region is a region covered with a light shielding layer formed above a layer with the pixels provided thereon when viewed from a side of an image display surface.

4. The electrooptical device according to claim 1, wherein the control unit determines the first region and the second region based on control information input from the outside.

5. A control method of an electrooptical device that includes a plurality of scanning lines, a plurality of data lines, and pixels that are provided so as to correspond to the respective intersections between the plurality of scanning lines and the plurality of data lines, the method comprising:

supplying a scanning signal to the scanning lines;

supplying a first voltage with a magnitude in accordance with a tone to be displayed to the pixels via the data lines;

supplying a second voltage to the data lines before the supply of the first voltage; and when the second voltage is supplied, connecting the data lines and an output unit of the second voltage when the scanning signal is supplied to the scanning lines in a first region and not connecting the data lines and the output unit of the second voltage when the scanning signal is supplied to the scanning lines in a second region, wherein the first voltage is an image signal, the second voltage is a pre-charge signal different from the image signal, and the second voltage is supplied to only a fixed subset of the pixels, the fixed subset of the pixels being located in the first region.

6. The control method of an electrooptical device according to claim 5, wherein the second region is arranged in each of stages before and after the first region in an arrangement direction of the scanning lines along the data lines.

7. The control method of an electrooptical device according to claim 5, wherein the second region is a region covered with a light shielding layer formed above a layer with the pixels provided thereon when viewed from a side of an image display surface.

8. The control method of an electrooptical device according to claim 5, wherein the first region and the second region are determine based on control information input from the outside.

9. An electronic device comprising:

electrooptical device according to claim 1.

* * * * *